US008752340B1

(12) United States Patent
Hartman

(10) Patent No.: US 8,752,340 B1
(45) Date of Patent: Jun. 17, 2014

(54) DOME STRUCTURE

(71) Applicant: Richard Lee Hartman, Cibolo, TX (US)

(72) Inventor: Richard Lee Hartman, Cibolo, TX (US)

( * ) Notice: Subject to any disclaimer, the term of this patent is extended or adjusted under 35 U.S.C. 154(b) by 0 days.

(21) Appl. No.: 13/682,809

(22) Filed: Nov. 21, 2012

(51) Int. Cl.
*E04B 1/32* (2006.01)

(52) U.S. Cl.
USPC ..... 52/80.1; 52/81.1

(58) Field of Classification Search
USPC ..... 52/80.1, 81.1, 81.2, 81.3, 81.4, 86, 52/747.1
See application file for complete search history.

(56) References Cited

U.S. PATENT DOCUMENTS

| | | | | | |
|---|---|---|---|---|---|
| 3,343,324 | A | * | 9/1967 | Gordon | 52/396.1 |
| 3,744,205 | A | | 7/1973 | Moss | |
| 3,871,143 | A | | 3/1975 | Quick | |
| 3,918,233 | A | * | 11/1975 | Simpson | 52/745.07 |
| 4,012,872 | A | | 3/1977 | Stolpin | |
| 4,075,813 | A | * | 2/1978 | Nalick | 52/745.07 |
| 4,287,690 | A | * | 9/1981 | Berger et al. | 52/81.4 |
| 4,309,852 | A | | 1/1982 | Stolpin | |
| 4,611,441 | A | | 9/1986 | Wickens | |
| 4,625,472 | A | | 12/1986 | Busick | |
| 4,788,803 | A | * | 12/1988 | Seitz | 52/82 |
| 5,291,702 | A | * | 3/1994 | Hooper | 52/80.1 |
| 5,452,555 | A | | 9/1995 | Lee | |
| 5,732,518 | A | * | 3/1998 | Roberts | 52/245 |
| 5,916,097 | A | * | 6/1999 | Markuten | 52/81.2 |
| 5,918,438 | A | * | 7/1999 | South | 52/745.07 |
| 5,950,512 | A | | 9/1999 | Fields | |
| 6,588,157 | B1 | * | 7/2003 | Davies | 52/81.1 |
| 6,739,797 | B1 | | 5/2004 | Schneider | |
| 6,840,013 | B2 | * | 1/2005 | South | 52/2.15 |
| 6,880,298 | B2 | * | 4/2005 | Davies | 52/81.1 |
| 6,996,942 | B2 | * | 2/2006 | Geiger | 52/81.3 |
| 7,192,329 | B2 | * | 3/2007 | Lee | 446/116 |
| 7,765,746 | B2 | * | 8/2010 | Reed | 52/80.1 |
| 8,191,318 | B2 | * | 6/2012 | Kitagawa | 52/82 |
| 2009/0025306 | A1 | * | 1/2009 | Reed | 52/80.1 |

* cited by examiner

*Primary Examiner* — Jeanette E Chapman
*Assistant Examiner* — James Buckle, Jr.
(74) *Attorney, Agent, or Firm* — Molly D. McKay

(57) ABSTRACT

A dome structure constructed of interlocking pieces constructed of plastic with a hollow or insulated interior. The pieces interlock via their alternating male and female edges and are secured at their vertices with wishbone locking connectors. The pieces are generally in the shape of simple polygons and overhang at their edges to prevent water leakage. In constructing a dome, the floor is first constructed from interlocking floor pieces and a perimeter track is constructed from special interlocking track pieces that can be filled with water or sand. A first row of pieces that will form the wall interlock with the perimeter track, and the dome is constructed by interlocking additional pieces after the initial row is in place. The last piece to be secured in place is modified so that it can be placed in the space remaining at the top of the dome.

15 Claims, 8 Drawing Sheets

DOME STRUCTURE

CROSS-REFERENCE TO RELATED APPLICATIONS

The present application claims priority to U.S. Provisional Patent Application Ser. No. 61/564,398 filed on Nov. 29, 2011 for Dome Structure.

BACKGROUND OF THE INVENTION

1. Field of the Invention

The present invention relates to a dome structure constructed of interlocking pieces, the interlocking pieces for constructing a dome structure and a method of constructing a dome structure from interlocking pieces.

2. Description of the Related Art

Various types of dome structures have been proposed. Generally these structures are constructed of triangular framework that is covered with a water-repelling material such as polyethylene plastic sheeting or similar material.

Problems with prior dome structures included that they were difficult and time consuming to build and were constructed of heavy and bulky metal framework that did not lend itself readily to being lifted easily to remote construction sites. The present invention addresses these problems by providing insulated plastic components that are light in weight and that interlock together so that construction is fast and easy even for people who are unskilled in construction techniques. Also, because the components are relatively small and light in weight, they are readily transported by air to remote regions of the world where conditions require quick construction of shelters on a widespread basis, such as after a tsunami or other similar disaster.

SUMMARY OF THE INVENTION

The present invention is a dome structure constructed of interlocking pieces, the interlocking pieces for constructing a dome structure and a method of constructing a dome structure from interlocking pieces. The pieces are insulated plastic components that can be interlocked together to construct dome structures in a variety of sizes and shapes for use as office or residential buildings.

The individual pieces are generally in the shape of a simple polygon. For purposes of illustration, the pieces will generally be described and illustrated as hexagons, i.e. polygons with six edges and six vertices. Each piece is constructed of plastic with a hollow interior separating an exterior side of the piece from an interior side of the piece. The hollow interior will be provided with internal plastic struts molded into it to strengthen it. The hollow interior of each piece will remain as be a dead air space that will serve to insulate the dome or can be filled with light weight rigid insulation material, such as closed-cell extruded polystyrene foam or other suitable insulating material.

Every other edge on the hexagon shaped pieces is preferably provided with a female edge and the alternating edges on the pieces are provided with male edges so that adjacent pieces interlock by inserting a male edge on one piece into a female edge of an adjacent piece. The male edges are preferably ribbed and slightly larger than the openings of the female edges so that after the male edge is inserted into the female edges the rib will secure or lock the two pieces together. The opening of the female edge would be smaller than the male edge and being plastic, it would expand as the male edge is inserted into it and then would resume its normal size after being snapped together, thereby locking itself to the male edge.

Also, a wishbone locking connector is used at each of the intersecting vertices of the pieces. As the pieces are fitted together, three different pieces with have their vertices intersect at a common point. Each wishbone locking connector is provided with three perpendicular legs with enlarged terminal ends such that one of the perpendicular legs inserts into a leg receiving opening provided at the vertices on the interior side of each of the three intersecting pieces. The pieces are additionally provided with an overhang on one or more of their edges as a means of diverting rain downward on the dome and to help prevent water leakage between adjacent pieces.

The dome is generally constructed of hexagon pieces, but additional pieces of other shapes will be required to construct the floor for the dome, the row of pieces at the intersection of the floor and the wall, around doorways and windows and as the top most pieces of the dome. Also, different shapes of domes may require special shaped pieces to construct the desired building shape.

In constructing a dome, the floor is first constructed from interlocking floor pieces and a perimeter track is constructed. Special interlocking track pieces are used to construct the perimeter track and to lock the perimeter track to the floor and to the wall of the dome. The track pieces are hollow with a fill hole and cap. Once the perimeter track pieces are interlocked, the caps are removed from the individual track pieces and the track pieces are filled with water or sand or other similar material to provide weight and rigidity to the perimeter track. The caps are returned to their fill holes to secure the fill material in the track pieces.

The perimeter track is provided with upward extending male ridges and female grooves for interlocking with the first row of pieces that will form the wall. Depending on the shape of the dome to be built and the layout and sizes of the doors and windows to be incorporated into the dome, the first row of pieces forming the wall of the dome that will be placed in the perimeter track will be specially modified in shape and the dome will then be constructed by interlocking additional pieces after the initial row is in place until the dome is constructed. In constructing the dome, the last piece to be placed in the dome may be of a slightly different shape from the other pieces and will be modified so that it can be placed in the space remaining at the top of the dome and can connect with the edges of adjacent pieces to complete the dome. For example, it may be necessary to have the last piece in the shape of a pentagon so that it will complete the dome.

DETAILED DESCRIPTION OF THE PREFERRED EMBODIMENT

Figure 1:
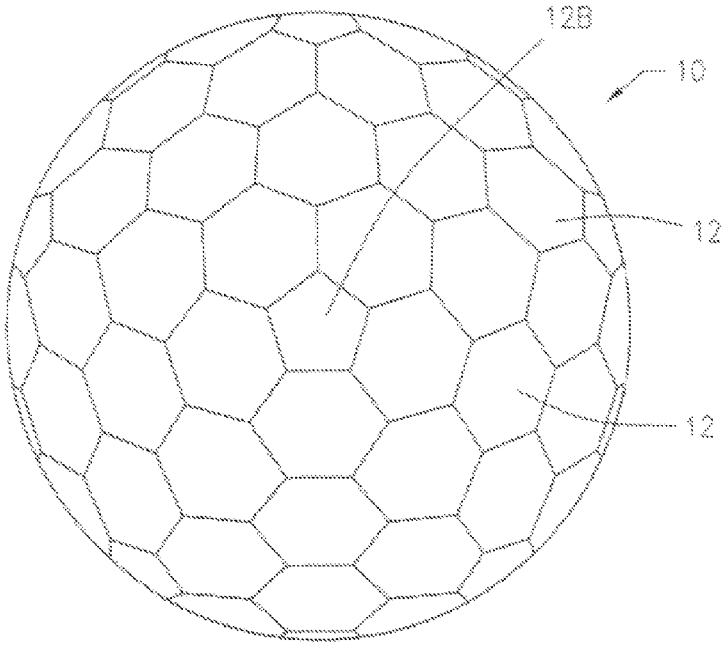
FIG. 1 is a top plan view of a dome constructed in according to the present invention. The invention is shown constructed without doors or windows for clarity.
Figure 16:
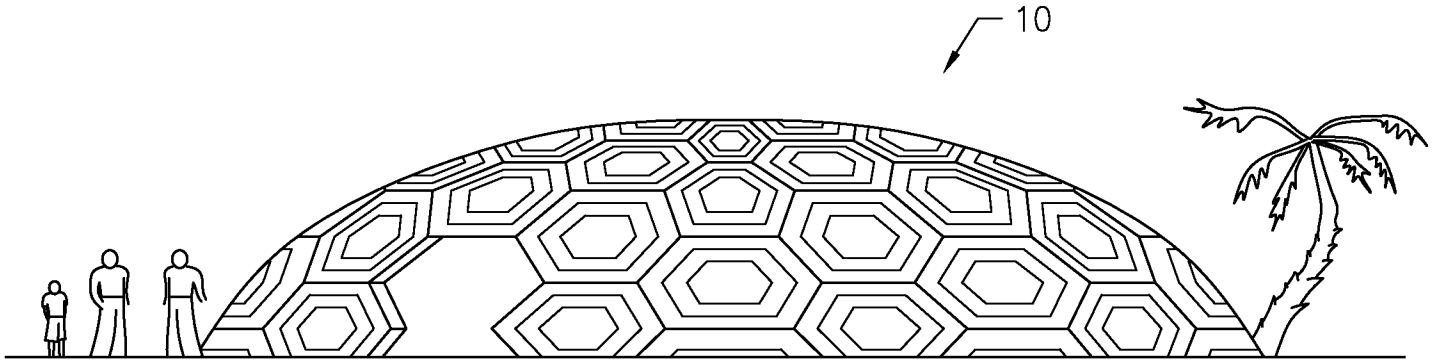
FIG. 16 is a perspective drawing of a dome constructed in accordance with a preferred embodiment of the present invention.

Referring now to the drawings and initially to FIGS. 1 and 16, there is illustrated a dome or dome structure 10 constructed of interlocking pieces 12 in constructed according to a preferred embodiment of the present invention. The pieces 12 are insulated plastic components that can be interlocked together to construct dome structures 10 in a variety of sizes and shapes for use as office or residential buildings.

Figure 2:
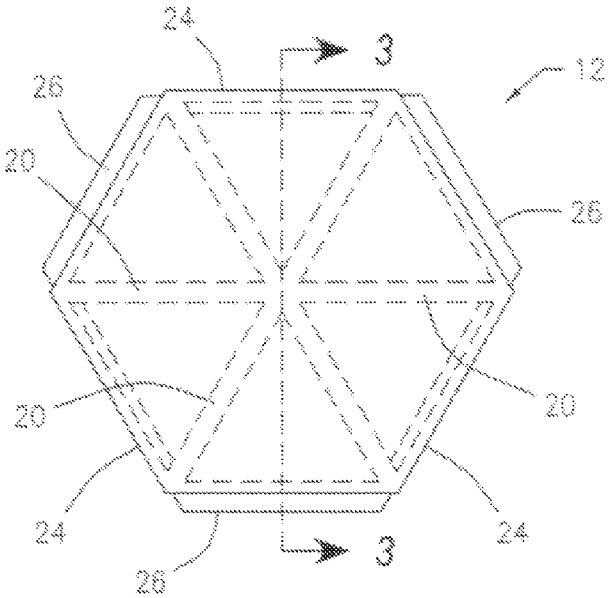
FIG. 2 is a bottom plan view of a piece used in the construction of the dome of FIG. 1 showing internal structure in outline.

Referring also to FIG. 2, the individual pieces 12 are generally in the shape of a simple polygon. For purposes of illustration, the majority of the pieces 12 will generally be described and illustrated as hexagons, i.e. polygons with six edges and six vertices or corners. Each piece 12 is constructed of plastic with a hollow interior space 14 separating an exterior side 16 of the piece 12 from an interior side 18 of the piece 12. The exterior sides 16 will ultimately be located on the outside of the dome 10 and the interior sides 18 will be located on the inside of the dome 10.

Figure 3:
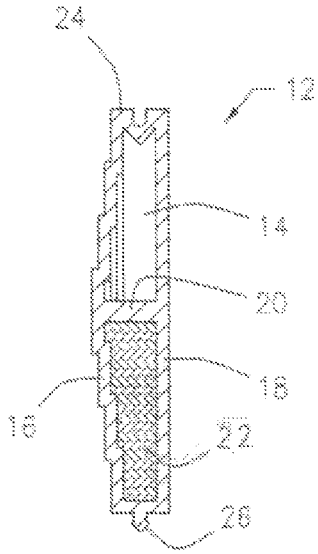
FIG. 3 is a cross sectional view taken along line 3-3 of FIG. 2.

Referring now to FIGS. 2 and 3, the hollow interior 14 of each piece 12 will be provided with internal plastic struts 20 that are preferably integrally molded into it to strengthen it. As shown in FIG. 3, the hollow interior 14 of each piece 12 will remain as be a dead air space that will serve to insulate the dome 10, or alternately, can be filled with light weight rigid insulation material 22, such as closed-cell extruded polystyrene foam or other suitable insulating material.

Figure 4:
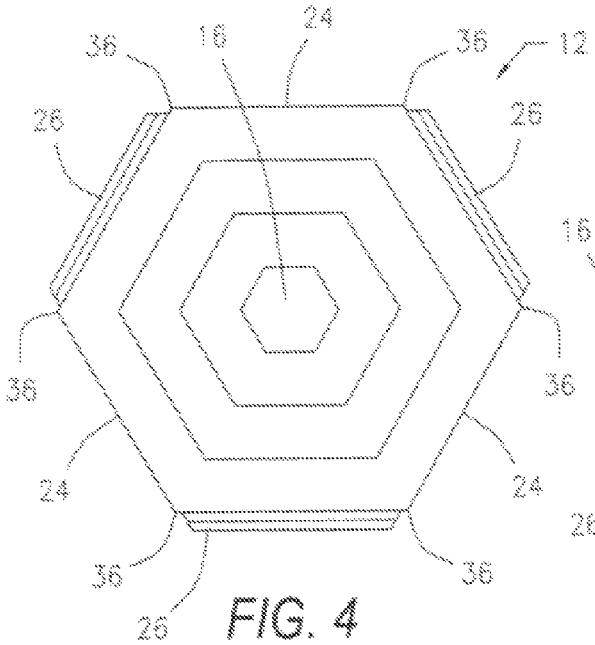
FIG. 4 is a top plan view of the piece of FIG. 2.
Figure 5:
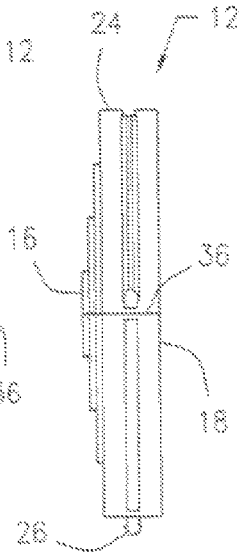
FIG. 5 is side view of the piece of FIG. 4.
Figure 6:
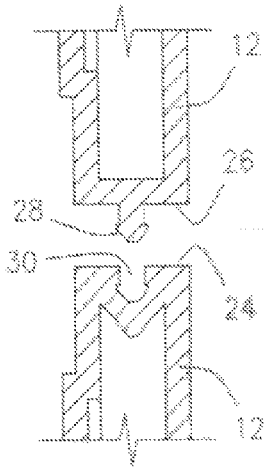
FIG. 6 is an enlarged view of the male edge of the piece of FIG. 5 shown in association with a mating female edge of another piece.
Figure 7:
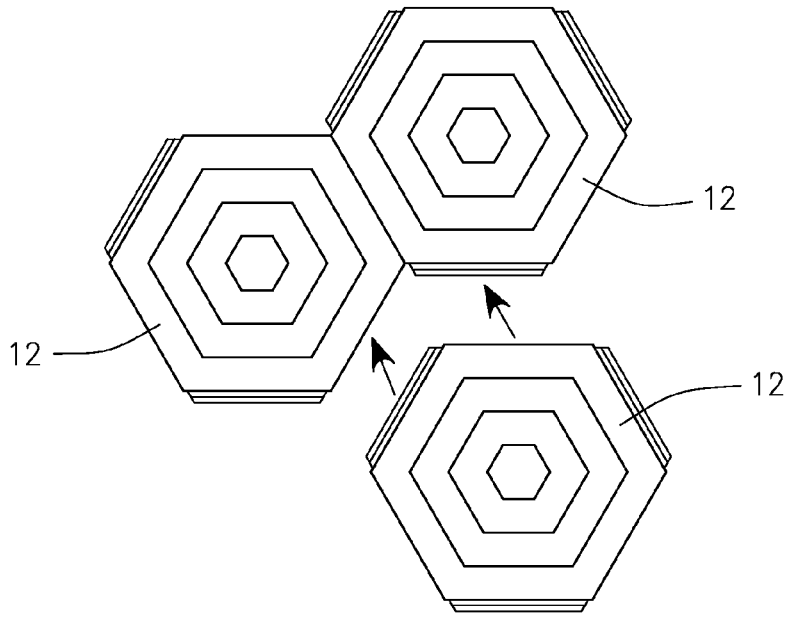
FIG. 7 is a perspective view of several pieces being fitted together

Referring now to FIGS. 4-6, every other edge on the hexagon shaped pieces 12 is preferably provided with a female edge 24 and the alternating edges on the pieces 12 are provided with male edges 26 so that adjacent pieces 12 interlock by inserting a male edge 26 on one piece 12 into a female edge 24 of an adjacent piece 12. As shown in FIG. 6, the male edges 26 are preferably provided with ribbed ends 28 that are slightly larger than the openings 30 of the female edges 24 so that after the male edges 26 are inserted into the female edges 24, the ribs 28 will secure or lock the two pieces 12 together. The opening 30 of the female edge 24 would be smaller than the rib 28 on the male edge 26 and being plastic, it would expand as the male edge 26 is inserted into it and then would resume its normal size after being snapped together, thereby locking itself to the male edge 26. FIG. 7 illustrates how the pieces 12 snap together.

Figure 8:
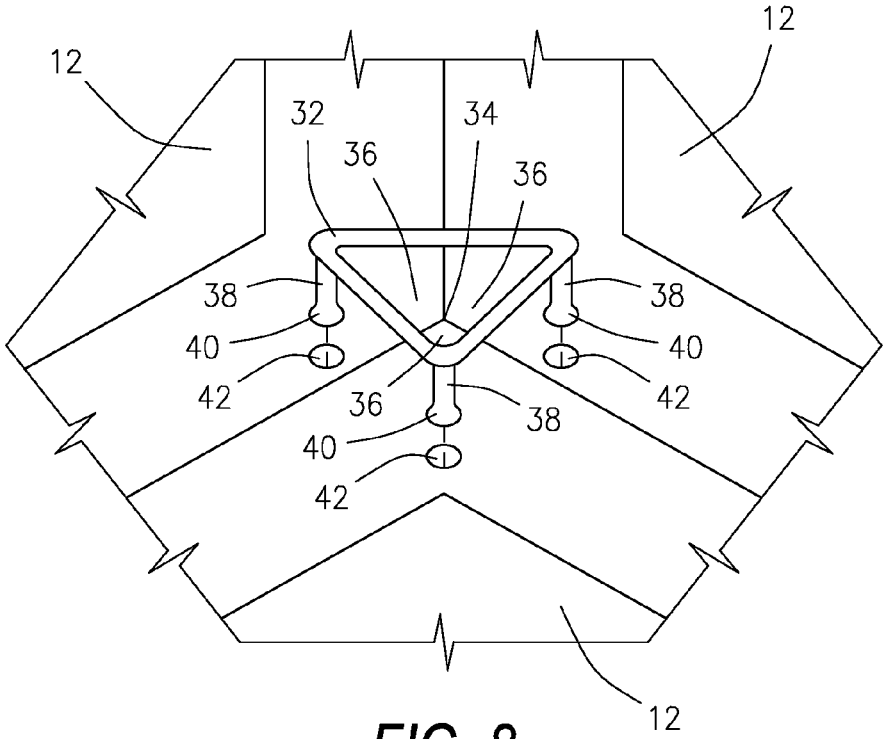
FIG. 8 is an enlarged view of the intersection of three pieces and the wishbone locking connector that is being inserted into the leg openings of the pieces to secure them together.

Also, as illustrated in FIG. 8, a wishbone locking connector 32 is used at each of the intersections 34 of vertices 36 of the pieces 12. As the pieces 12 are fitted together, three different pieces 12 with have their vertices 36 intersect at a common point or intersection 34. Each wishbone locking connector 32 is provided with three perpendicular legs 38 and each leg 38 is provided with an enlarged terminal end 40 such that one of the legs 38 inserts into a leg receiving opening 42 provided at the vertices 36 on the interior side 18 of each of the three intersecting pieces 12.

Although not specifically illustrated, the pieces 12 may be additionally provided with an overhang on one or more of their edges 24 and 26 as a means of diverting rain downward on the dome 10 and to help prevent water leakage between adjacent pieces 12.

Figure 10:
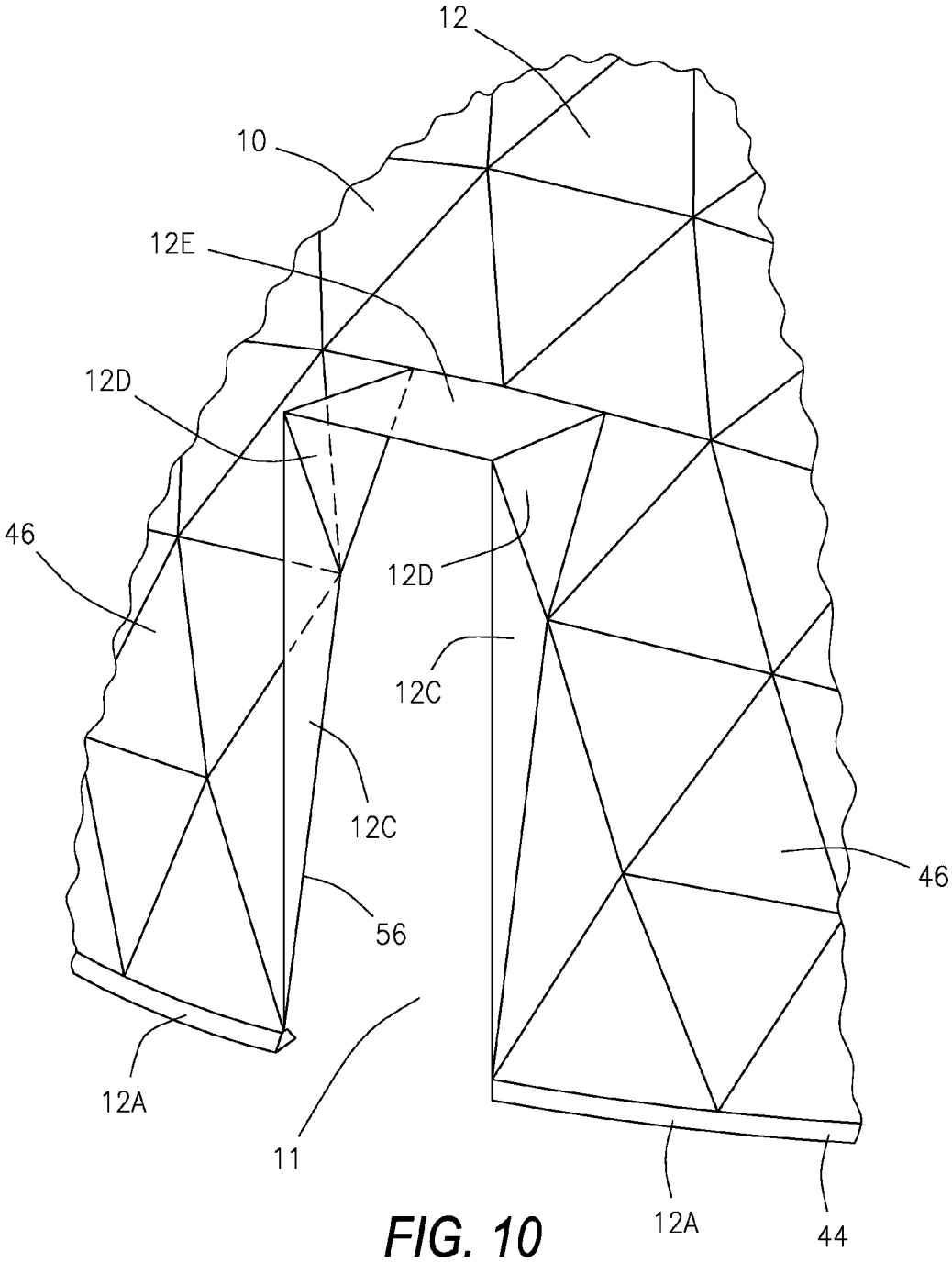
FIG. 10 is a perspective view of a doorway of the dome illustrating the modified pieces used to surround the doorway.

The dome 10 is generally constructed of hexagon pieces 12, but additional pieces 12A, 12B, 12C, etc. of other shapes will be required to construct the floor for the dome 10, the first rows of pieces 12 at the intersection of the floor and the wall, the areas around doorways and windows, and as the top most pieces 12 of the dome 10. Also, different shapes of domes (not illustrated) may require special shaped pieces 12A, 12B, 12C, etc. to construct the desired building shape. For example, FIG. 10 shows several different shapes of pieces 12C, 12D, 12E needed to construct a doorway 56 for a dome 10.

Figure 11:
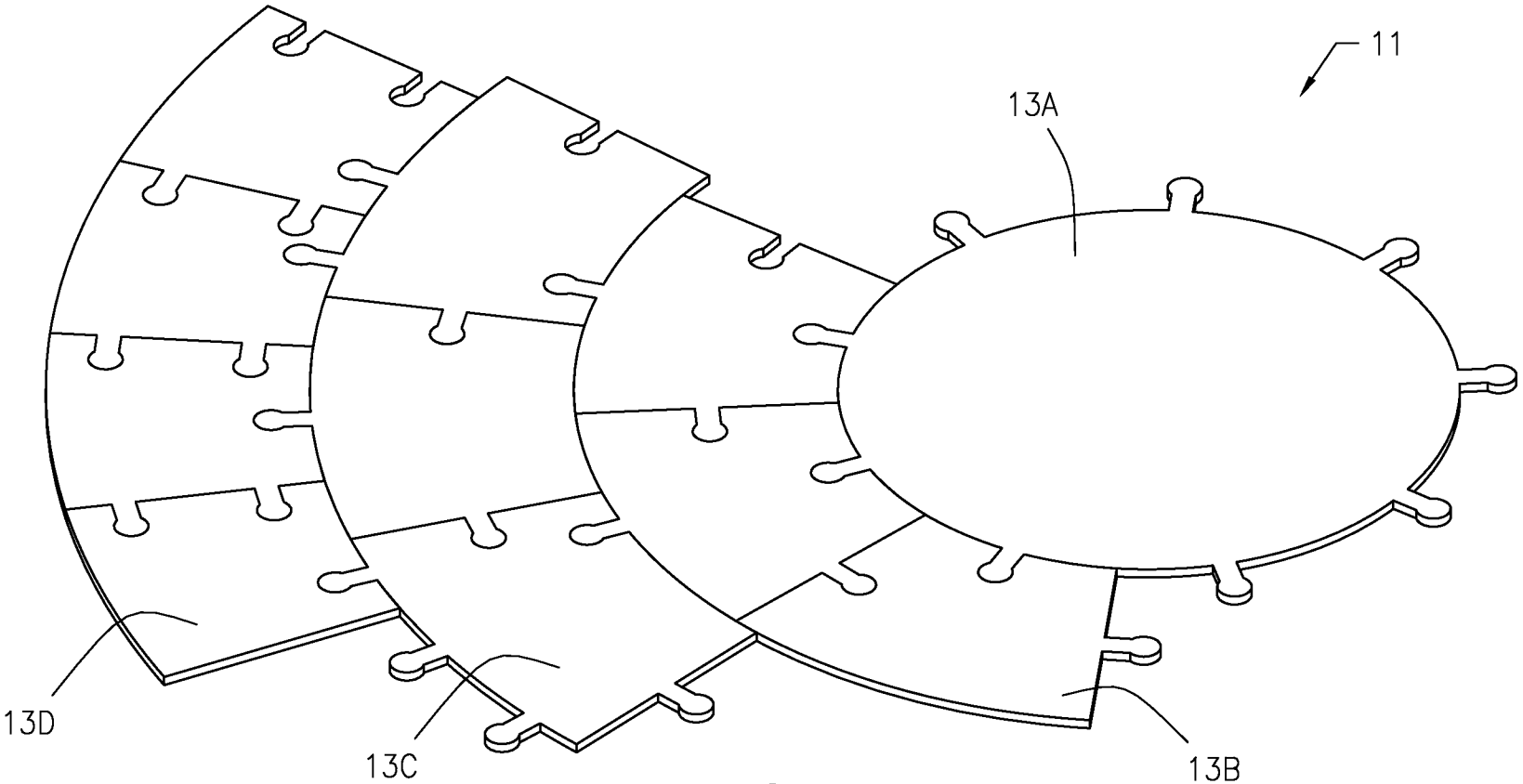
FIG. 11 is a perspective view of a centerpiece for the floor of the dome of FIG. 1 showing how floor pieces connect together and connect to the centerpiece to construct the floor.
Figure 12:
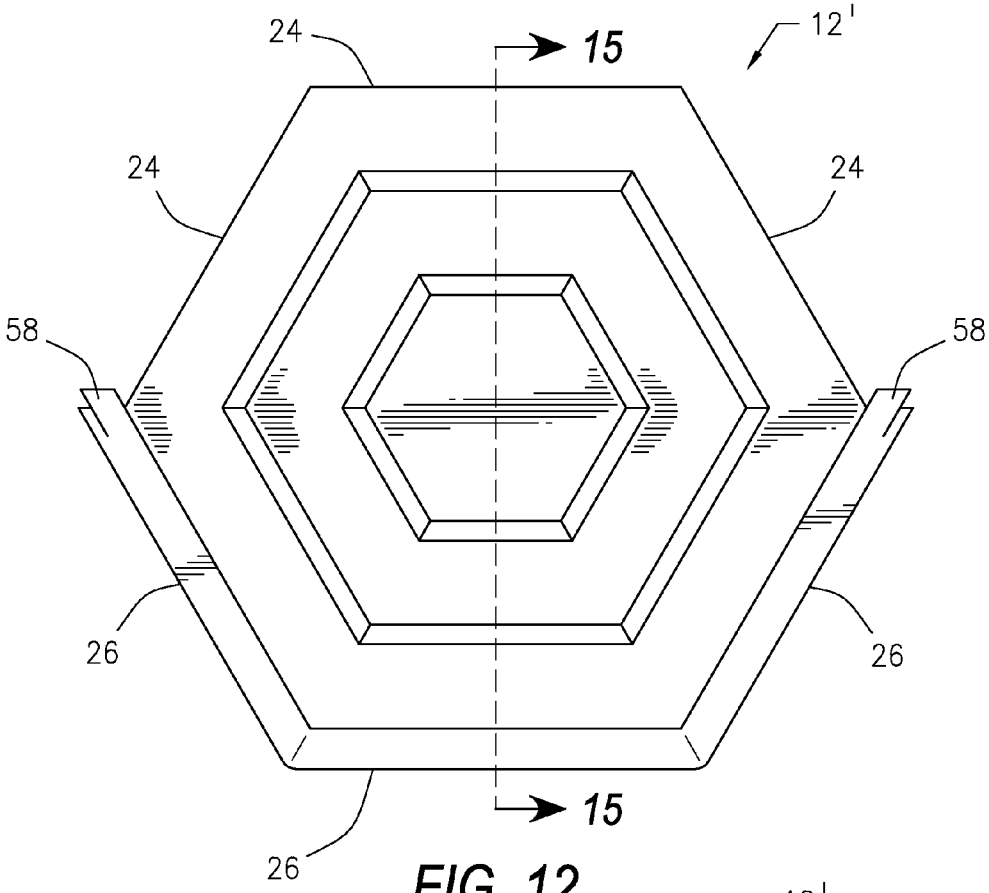
FIG. 12 is a top plan view of a piece constructed in accordance with a preferred embodiment of the present invention for use in building a dome.
Figure 13:
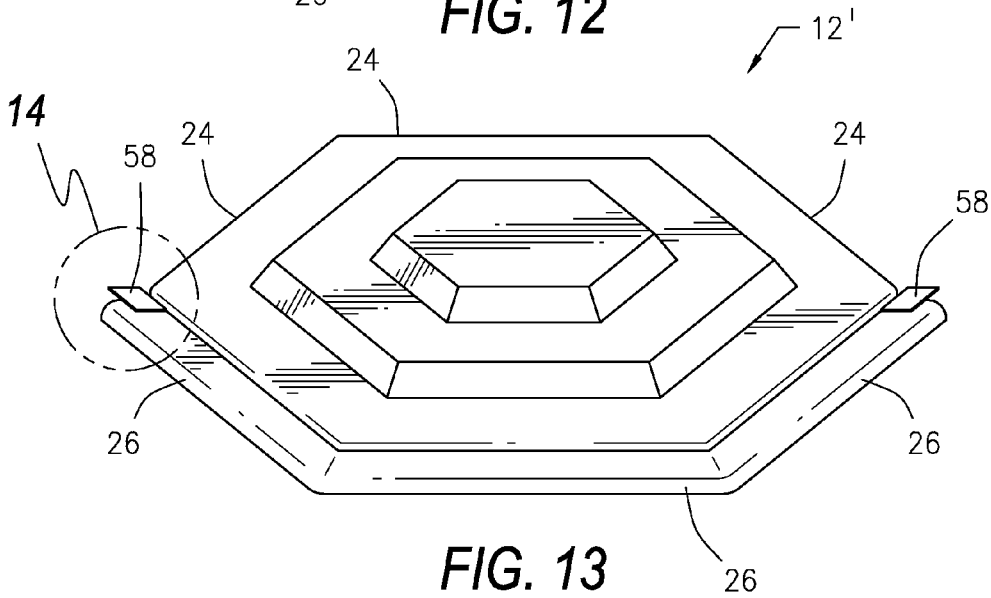
FIG. 13 is a perspective view of the piece of FIG. 12.
Figure 14:
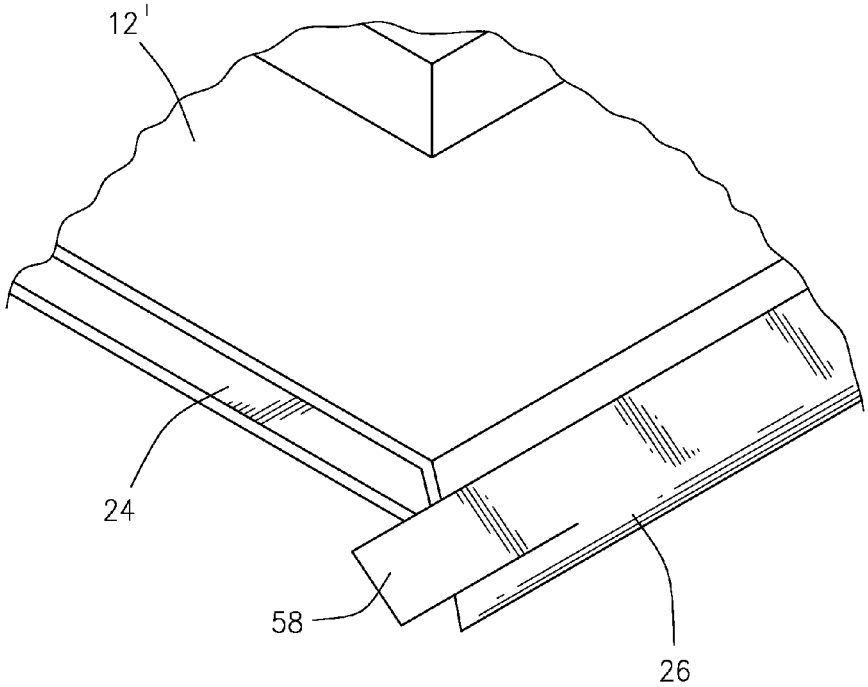
FIG. 14 is an enlarged view of the area within circle 14 of FIG. 13.
Figure 15:
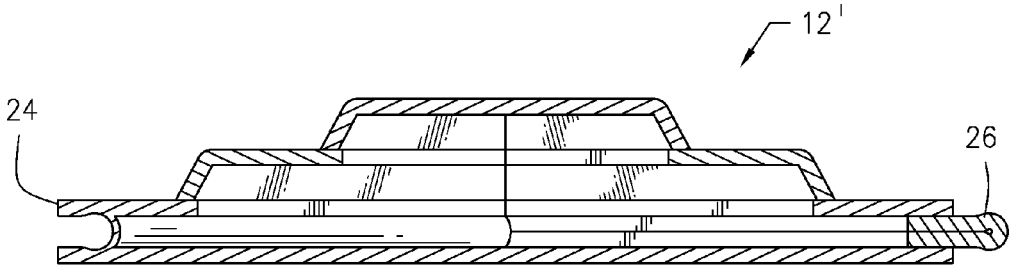
FIG. 15 is a cross sectional view taken along line 15-15 of FIG. 12.

In constructing a dome 10, the floor 11 is generally constructed first. Referring to FIG. 11, the floor 11 may be made from interlocking floor pieces 13B, 13C, and 13D which are secured to a centerpiece 13A, as illustrated in FIG. 11. Alternately, the floor 11 or may be constructed in other ways or using other methods.

Figure 9:
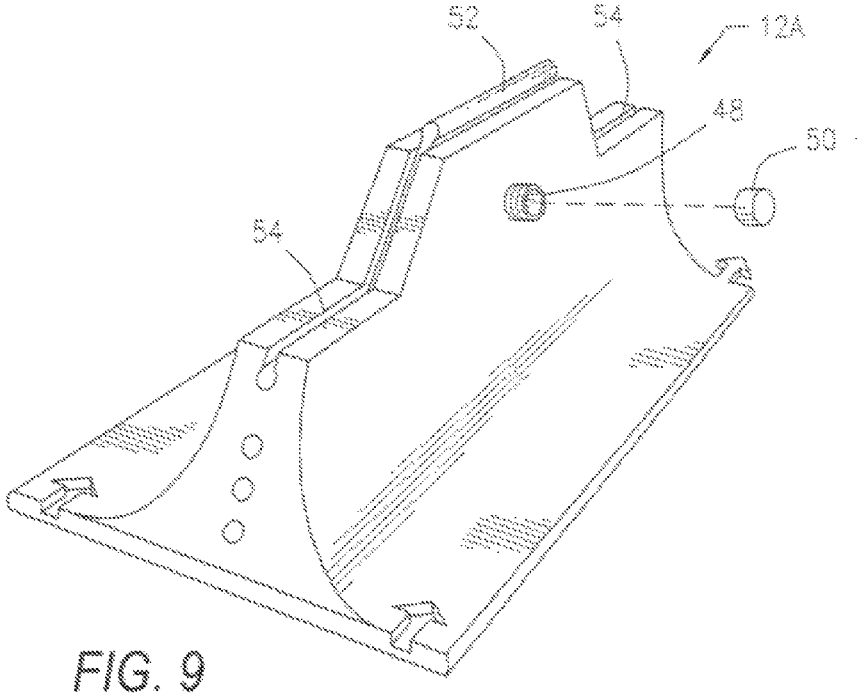
FIG. 9 is a perspective view of a tracking piece from which the perimeter track of the dome is constructed.

Then a perimeter track 44 of the dome 10 is constructed. As shown in FIG. 9, special interlocking track pieces 12A are used to construct the perimeter track 44 and to lock the perimeter track 44 to the floor or to the ground, if desired, and to the wall 46 of the dome 10. Each track piece 12A is provided with a hollow interior that is accessed via a fill hole 48 that is removably sealable with a cap 50. Once the perimeter track pieces 12A are interlocked together to form the track 44, the caps 50 are removed from the individual track pieces 12A and the track pieces 12A are filled with water or sand or other similar material to provide weight and rigidity to the perimeter track 44. The caps 50 are returned to their fill holes 48 to secure the fill material within the track pieces 12A.

The perimeter track pieces 12A is each provided with upwardly extending male ridges 52 and female grooves 54 for interlocking with the first row of pieces 12 that will form the wall 46 of the dome 10. Depending on the shape of the dome 10 to be built and the layout and sizes of the doorways 56 and windows (not illustrated) to be incorporated into the dome 10, the first row of pieces that will be interlock with the perimeter track 44 to form the wall 46 of the dome 10 will need to be specially modified in their shapes and the dome 10 will then be constructed by interlocking additional pieces 12 after the initial row is in place until the dome 10 is constructed.

In constructing the dome 10, the last piece 12B to be placed in the dome 10 may be of a slightly different shape from the other pieces 12 and will be modified so that it can be placed in the space remaining at the top of the dome 10 and can connect with the edges 24 and 26 of adjacent pieces 12 to complete the dome 10. For example, as illustrated in FIG. 1, it may be necessary to have the last piece 12 in the shape of a pentagon so that it will complete the dome 10.

Referring now to FIGS. 12-15, there is illustrated an alternate piece 12' that is constructed in accordance with a preferred embodiment of the present invention for use in building a dome structure 10. This alternate piece 12' differs from the piece 12 illustrated in FIGS. 2-6 in that the male edges 26 are adjacent each other on the alternate piece 12' and the female edges 24 are adjacent each other on the alternate piece 12' instead of having alternating male and female edges 26 and 24 as provided on the piece 12.

Each male edge 26 that is located adjacent to a female edge 24 on the alternate piece 12' is provided with an overhang tab 58 that serves to divert water away from the intersections 34 of vertices 36 of the alternate pieces 12' when the alternate pieces 12' are secured together. Also, although not specifically illustrated, where the male edges meet with the female edges on each alternate piece 12', the alternate piece is provided with sealing gaskets or other means to prevent leakage at these locations.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A dome building structure constructed of interlocking pieces comprising:

interlocking pieces each provided with male and female edges that secure the pieces together to create an enclosed building structure, the male edges provided with ribbed ends, the female edges provided with openings such that a ribbed end of one piece inserted into a female edge opening of another piece secures the two pieces together, locking connectors provided at each intersection of vertices of the pieces to secure the interlocking pieces together at their vertices, and wherein each locking connector includes a base portion with three or more perpendicular legs thereto, and each leg of the locking connectors provided with an enlarged terminal end that inserts into a leg receiving opening provided in the pieces at the vertices on the interior side of each intersecting piece.

2. A dome building structure constructed of interlocking pieces according to claim 1 wherein each piece in the shape of simple polygon.

3. A dome building structure constructed of interlocking pieces according to claim 1 further comprising:

each piece provided with an overhang tab on one or more of its edges as a means of diverting rain to help prevent water leakage between adjacent pieces.

4. A dome building structure constructed of interlocking pieces according to claim 1 wherein the male and female edges alternate on each piece.

5. A dome building structure constructed of interlocking pieces according to claim 1 wherein the male edges are adjacent to each other on each piece and the female edges are adjacent to each other on each piece.

6. A dome building structure constructed of interlocking pieces according to claim 1 further comprising:

each said piece provided with a hollow interior space separating an exterior side of the piece from an interior side of the piece.

7. A dome building structure constructed of interlocking pieces according to claim 6 wherein the hollow interior of each piece is a dead air space that serves to insulate the building structure created by the pieces.

8. A dome building structure constructed of interlocking pieces according to claim 6 wherein the hollow interior of each piece is filled with insulation material that insulates the building structure created by the pieces.

9. A dome building structure constructed of interlocking pieces comprising:

interlocking pieces each provided with male and female edges that secure the pieces together to create an enclosed building structure, each said piece provided with a hollow interior space separating an exterior side of the piece from an interior side of the piece, and internal struts integrally molded in the hollow interior of each piece to strengthen the piece.

10. A dome building structure constructed of interlocking pieces according to claim 1 wherein the majority of the pieces are hexagons.

11. A dome building structure constructed of interlocking pieces according to claim 1 further comprising:

a floor constructed of interlocking pieces, outer edges of said floor attached to a perimeter track, the perimeter track formed of perimeter track pieces, and each perimeter track piece provided with upwardly extending male ridges and female grooves for interlocking with a first row of interlocking pieces that will form a wall of the building structure.

12. A dome building structure constructed of interlocking pieces comprising:

interlocking pieces each provided with male and female edges that secure the pieces together to create an enclosed building structure, a floor constructed of interlocking pieces, outer edges of said floor attached to a perimeter track, the perimeter track formed of perimeter track pieces, each perimeter track piece provided with upwardly extending male ridges and female grooves for interlocking with a first row of interlocking pieces that will form a wall of the building structure, and each track piece having a hollow interior that is accessed via a fill hole that is removably sealable with a cap so that the hollow interior can be filled with material to provide weight and rigidity to the perimeter track constructed from the track pieces.

13. A dome building structure constructed of interlocking pieces according to claim 1 wherein a last piece to be placed in the building structure will be of a different shape from the other pieces and will be modified so that it can be placed in the space remaining at the top of the building structure and can connect with the edges of adjacent pieces to complete the building structure.

14. A method for constructing a dome building structure from interlocking pieces comprising the following steps:

a. constructing a perimeter track from interlocking track pieces that can be filled with material to provide weight and rigidity to the perimeter track, b. securing a first row of interlocking pieces to upwardly extending male ridges and female grooves provided on the interlocking track pieces to form the first row of interlocking pieces of a wall of the building structure c. continuing to secure additional interlocking pieces to the wall of the building structure to create the wall and ceiling of the building structure and doorway and window openings, and d. securing a last piece in a space remaining at the top of the ceiling to complete the building structure.

15. A method for constructing a dome building structure from interlocking pieces according to claim 14 further comprising the following steps that occur prior to step a:

e. constructing a floor for the building structure of interlocking floor pieces, and f. securing the perimeter track to a perimeter of said floor.

* * * * *